US009439017B2

(12) United States Patent
Hedenig et al.

(10) Patent No.: US 9,439,017 B2
(45) Date of Patent: Sep. 6, 2016

(54) METHOD FOR MANUFACTURING A PLURALITY OF MICROPHONE STRUCTURES, MICROPHONE AND MOBILE DEVICE

(71) Applicant: Infineon Technologies AG, Neubiberg (DE)

(72) Inventors: Ursula Hedenig, Villach (AT); Daniel Maurer, Feld am See (AT); Thomas Grille, Villach (AT); Peter Irsigler, Obernberg/Inn (AT); Soenke Pirk, Villach (AT); Andre Brockmeier, Villach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 39 days.

(21) Appl. No.: 14/176,182

(22) Filed: Feb. 10, 2014

(65) Prior Publication Data

US 2015/0230039 A1 Aug. 13, 2015

(51) Int. Cl.
*H04R 31/00* (2006.01)
*H04R 23/00* (2006.01)
*H04R 19/00* (2006.01)

(52) U.S. Cl.
CPC ..... *H04R 31/00* (2013.01); *H04R 19/005* (2013.01); *H04R 23/00* (2013.01); *H04R 2201/003* (2013.01); *Y10T 29/49* (2015.01)

(58) Field of Classification Search
CPC ..... H04R 1/1016; H04R 1/105; H04R 1/04; H04R 19/04; H04R 1/08; H04R 25/407; H04R 25/604; H04R 25/652; H04R 25/658; H04R 31/006; H04R 3/00; Y10T 29/49005; Y10T 29/4908
USPC ..... 29/417, 592.1, 594, 609.1; 381/352, 381/355, 357, 358, 360, 361, 365, 368, 369
See application file for complete search history.

(56) References Cited

U.S. PATENT DOCUMENTS

| | | | | |
|---|---|---|---|---|
| 7,835,533 | B2 * | 11/2010 | Yonehara | H04R 19/016 29/594 |
| 8,050,443 | B2 * | 11/2011 | Izuchi | H04R 19/016 381/174 |
| 8,553,921 | B2 * | 10/2013 | Yao | H04R 19/04 381/174 |
| 8,575,037 | B2 * | 11/2013 | Friza | B81C 1/00047 438/761 |
| 8,637,945 | B2 * | 1/2014 | Reichenbach | H04R 19/005 156/184 |
| 8,871,550 | B2 * | 10/2014 | Grille | H04R 19/005 257/E21.219 |
| 2015/0217997 | A1 * | 8/2015 | Grille | B81C 1/00896 257/416 |

* cited by examiner

*Primary Examiner* — Paul D Kim

(57) ABSTRACT

In various embodiments, a method for manufacturing microphone structures is provided. The method may include: Providing a substrate having a front side and a back side, the backside facing away from the front side, and having an inner area and an outer area laterally surrounding the inner area, with the inner area comprising a plurality of microphone areas each microphone are being provided for one microphone of the plurality of microphones; Forming a plurality of layers for the plurality of microphones in the microphone areas on the front side of the substrate; Forming a recess from the backside of the substrate with the recess laterally overlapping the entire inner area; Forming a plurality of cavities into a bottom of the recess with each cavity of the plurality of cavities being formed in one of the microphone areas; Processing the layers to form the plurality of microphone structures, wherein each microphone structure comprises at least one layer of the plurality of layers and one cavity; and Separating the plurality of microphone structures from each other.

16 Claims, 3 Drawing Sheets

METHOD FOR MANUFACTURING A PLURALITY OF MICROPHONE STRUCTURES, MICROPHONE AND MOBILE DEVICE

TECHNICAL FIELD

Various embodiments relate generally to a method for manufacturing a plurality of microphone structures, a method for manufacturing a plurality of micro-electro-mechanical system microphones, and a microphone.

BACKGROUND

Micro-electro-mechanical systems (MEMS) may widely be used in technical devices. There may be for example MEMS microphones or other devices, such as for example a pressure sensor, which may be used in mobile devices such as mobile phones, such as for example smartphones, tablet PCs, pagers, portable PCs, Headsets, etc. Such a microphone may also be called microphone chip or microphone. A pressure-sensitive membrane, for example a diaphragm, is usually etched directly into a chip, for example a silicon chip, by MEMS techniques, and is usually accompanied with an integrated preamplifier. Most MEMS microphones are variants of the so-called condenser microphone design. MEMS microphones often have built in analog-to-digital converter (ADC) circuits on the same IC chip making the chip become a digital microphone and so more readily integrated with modern digital products mentioned above.

The usage of a conventional MEMS microphone may often be limited by the thickness of the corresponding substrate. Additionally, a thick substrate may lead to a small back volume behind the microphone in the corresponding device which may contribute to a low signal-to-noise ratio. However, the thinner the substrate is, the more difficult the handling of the substrate may become, because the substrate may be more sensitive against external mechanical influences during production and assembly. Therefore, a conventional microphone includes a substrate having a thickness not smaller than 300 μm.

SUMMARY

In various embodiments, a method for manufacturing microphone structures may be provided. The method may include: providing a substrate having a front side and a back side, the backside may face away from the front side, and having an inner area and an outer area laterally surrounding the inner area, wherein the inner area may include a plurality of microphone areas, wherein each microphone may be provided for one microphone of the plurality of microphones; forming a plurality of layers for the plurality of microphones in the microphone areas on the front side of the substrate; forming a recess from the backside of the substrate with the recess laterally overlapping the entire inner area; forming a plurality of cavities into a bottom of the recess with each cavity of the plurality of cavities being formed in one of the microphone areas; processing the layers to form the plurality of microphone structures, wherein each microphone structure may include at least one layer of the plurality of layers and one cavity; and separating the plurality of microphone structures from each other.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
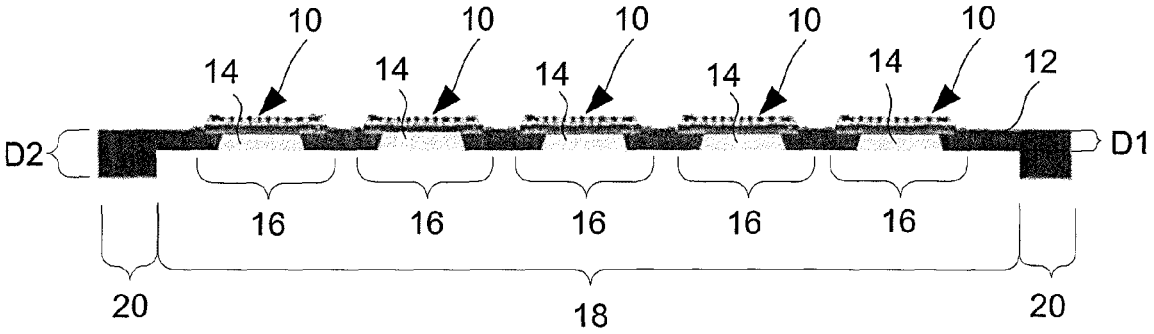
FIG. 1 shows a cross-sectional view of an embodiment of a substrate including a plurality of microphones.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

In various embodiments a method for manufacturing a plurality of microphone structures may be provided. The method may contribute to that microphones formed by the microphone structures may have a good signal-to-noise ratio and/or may contribute to low manufacturing costs and/or may be carried out in a simple and/or cost saving manner.

In various embodiments a microphone may be provided. The microphone may have a good signal-to-noise ratio and/or may be manufactured in a simple and/or cost saving manner.

In various embodiments a mobile device may be provided. The mobile device may include a microphone having a good signal-to-noise ratio and/or may be manufactured in a simple and/or cost saving manner.

In various embodiments a method for manufacturing a plurality of microphone structures may be provided. The method may include: providing a substrate having a front side and a back side, the backside facing away from the front side, and having an inner area and an outer area laterally surrounding the inner area, with the inner area including a plurality of microphone areas, wherein each microphone may be provided for one microphone of the plurality of microphones; forming a plurality of layers for the plurality of microphones in the microphone areas on the front side of the substrate; forming a recess from the backside of the substrate with the recess laterally overlapping the entire inner area; forming a plurality of cavities into a bottom of the recess with each cavity of the plurality of cavities being formed in one of the microphone areas; processing the layers to form the plurality of microphone structures, wherein each microphone structure may include at least one layer of the plurality of layers and one cavity; and separating the plurality of microphone structures from each other.

Forming the recess may contribute to a very thin microphone structure and therefore to a very thin microphone. The thin microphone may be space saving, for example in a mobile device, e.g. a mobile communication device such as e.g. a mobile radio communication device, and may enable to have a big back volume behind the microphone in the mobile device. The big back volume may contributes to a low signal-to-noise ratio of the microphone and of the mobile device including the microphone. Further, forming the recess may lead to a very thin substrate in the inner area and may enable to form the cavities in a wet chemical etching process. The wet chemical etching process may contribute to manufacture the microphone structure in a simple and/or cost saving manner.

The microphone structure may form a complete microphone or may be a substantial element of a microphone. In various embodiments, the microphone structure may include a membrane of the microphone, with the membrane being configured to receive acoustic waves and to contribute to convert the acoustic waves in electromagnetic waves. The membrane may be formed by an electrode of the microphone. The processing of the layers may include removing an etch stop layer from the membrane of the microphone, the etch stop layer being provided as an etch stop during the formation of the cavities. The processing of the layers may include forming a hollow space between two electrodes of the microphone with one electrode forming the membrane of the microphone. The recess may be formed by removing the material of the substrate on the backside of the substrate, for example by a grinding process. If the substrate is circularly shaped, the lateral direction may correspond to a radial direction of the substrate. The lateral direction may be parallel to the front side or back side of the substrate.

In various embodiments, the substrate may have a first thickness in the inner area in the recess and a second thickness in the outer area outside the recess, wherein the second thickness may be larger than the first thickness.

In various embodiments, the recess may be formed such that the first thickness may be in a range from about 20 μm to about 400 μm.

In various embodiments, before the recess is formed, the substrate may be thinned such that the whole substrate has the second thickness.

In various embodiments, the second thickness may be in a range from about 300 μm to about 900 μm.

In various embodiments, the cavities may be formed by a wet chemical etching process.

In various embodiments, before the wet chemical etching process, an alkaline resistant photosensitive layer or an hardmask layer (silicon oxide, silicon nitride, carbon containing materials) structured by a photosensitive layer may be provided on the bottom of the recess. An exposure mask may be arranged on the backside of the substrate such that the mask may be in direct contact with the substrate in the outer area and that there may be a given distance between the mask and the bottom in the inner area. The mask may include a plurality of mask recesses each corresponding to one cavity of the plurality of cavities to be formed in the substrate. The photosensitive layer may be exposed through the mask recesses of the mask. In case of a wet etching process the layer may be an alkaline resistant photosensitive layer and in case of a dry etching process the layer may be a standard photosensitive layer.

In various embodiments, the cavities may be formed such that each cavity may include a circumferential slant, wherein an angle of the slant may be in a range from about 0° to 90°.

In various embodiments, a microphone may be provided. The microphone may include a substrate having a front side and a back side, with the backside facing away from the front side and with the substrate having a thickness in a range from about 20 μm to about 400 μm. A cavity may extend through the substrate. A plurality of layers may be formed on the front side of the substrate. The layers may overlap the cavity. The layers may include a first electrode over the cavity, a hollow space over the first electrode, and a second electrode over the hollow space, with the first electrode providing a membrane of the microphone.

In various embodiments, the cavity may include a circumferential slant, where the slant has an angle in range of 0° to 90°.

In various embodiments, a mobile device may be provided. The mobile device may include a microphone, for example the microphone and/or microphone structure as explained above.

In various embodiments, a method for manufacturing micro-electro-mechanical system (MEMS) microphones may be provided. The method may include providing a semiconductor substrate having a first side and a second side, the second side facing away from the first side, and having a plurality of microphone areas and a peripheral area laterally surrounding the microphone areas. A layer structure may be formed over the first side of the semiconductor substrate in the microphone areas. A recess may be formed from the second side of the substrate in the microphone areas. At least one cavity may be formed in the substrate in each microphone area. The layer structure may be processed to provide at least one MEMS microphone in each microphone area. The MEMS microphones may be separated from each other.

The microphone areas may form a common inner area of the substrate.

In various embodiments, the substrate may have a first thickness in the microphone areas and a second thickness in the peripheral area.

In various embodiments, the recess may be formed such that the first thickness is in a range from about 20 μm to about 400 μm.

In various embodiments, before the recess is formed, the substrate may be thinned such that the whole substrate may have the second thickness. In other words, the substrate may be thinned in a first thinning step such that the whole substrate may have the second thickness. Then, the substrate may be thinned in a second step such that the substrate may have the first thickness in the microphone areas.

In various embodiments, the second thickness may be in a range from about 300 μm to about 900 μm.

In various embodiments, the cavities may be formed preferably by a wet chemical etching process or more common by an anisotropic dry etching process. In case of a wet etching process an alkaline resistant photosensitive layer may be used and in case of a dry etching process a standard photosensitive layer may be used.

In various embodiments, before the wet chemical etching process, an alkaline resistant photosensitive layer or hardmask may be provided on the substrate in the recess, an exposure mask may be arranged on the second side of the substrate such that the mask may be in direct contact with the peripheral area of the substrate and that there may be a given distance between the mask and the substrate in the recess, wherein the mask may include a plurality of mask openings each corresponding to one of the cavities to be formed in the substrate, and wherein the alkaline resistant photosensitive layer or the photosensitive layer on the hardmask may be exposed through the mask openings of the mask.

In various embodiments, the cavities may be formed such that each cavity may include a circumferential slant, in which the thickness of the substrate may increase from zero to the first thickness, wherein the angle of the slant may be in a range from about 0° to 90°.

In various embodiments, a micro-electro-mechanical system (MEMS) microphone may be provided. The MEMS microphone may include a substrate having a first side and a second side, with the second side facing away from the first side and with the substrate having a thickness in a range from about 20 μm to about 400 μm. A cavity may extend through the substrate. A layer structure may be formed on the first side of the substrate, wherein the layer structure may include a membrane extending over the cavity, a hollow space over the membrane, and an electrode extending over the hollow space.

In various embodiments, a MEMS microphone the cavity may include a circumferential slant, wherein the angle of the slant may be in a range from 0° to 90°.

In various embodiments, a mobile device, including a MEMS microphone, for example the MEMS microphone above, may be provided.

FIG. 1 shows a cross-sectional view of a plurality of microphones 10 including a substrate 12. The substrate 12 may e.g. be a wafer, e.g. a semiconductor wafer. The microphones 10 may be formed by microphone structures, each microphone 10 may be arranged in a microphone area 16 on the substrate 12. The microphone areas 16 may be arranged in an inner area 18 of the substrate 12. The inner area 18 may be laterally surrounded by an outer area 20 of the substrate 12. The substrate 12 may have a first thickness D1 in the inner area 18 and a second thickness D2 in the outer area 20. The first thickness D1 may be smaller than the second thickness D2. For example, the first thickness D1 may be in a range from about 20 μm to about 400 μm, e.g. in a range from about 50 μm to about 300 μm, e.g. in a range from about 100 μm to about 150 μm. The second thickness D2 may be in a range from about 300 μm to about 900 μm, e.g. about 400 μm. Each microphone 10 may include at least one cavity 14, wherein the cavities 14 may be formed in the corresponding microphone areas 16.

Figure 2:
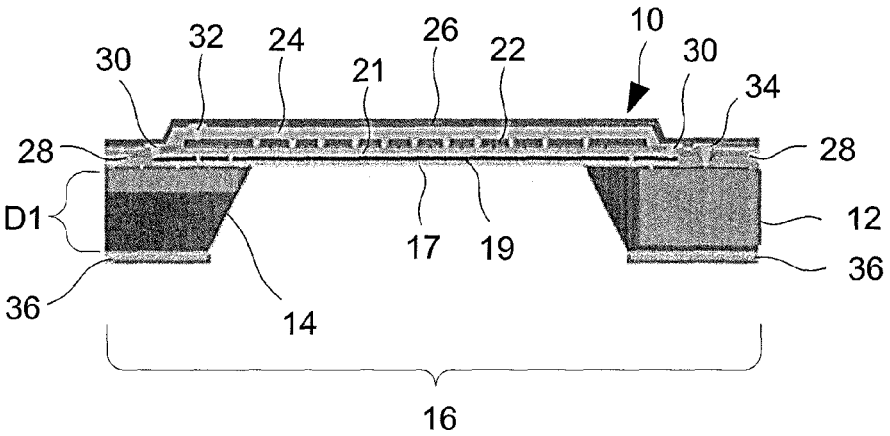
FIG. 2 shows a cross-sectional view of an embodiment of a microphone.

FIG. 2 shows a cutaway view of an embodiment of a microphone 10, e.g. one of the microphones 10 as explained above. The microphone 10 may include the part of the substrate 12 being arranged in the microphone area 16 and the cavity 14. The cavity 14 may be covered by an etch stop layer 17. The etch stop layer 17 may be provided as an etch stop during the formation of the cavity 14, if the cavity 14 may e.g. be formed by a chemical etching process. A first electrode 19 of the microphone 10 may be formed over the etch stop layer 17. The first electrode 19 may form a membrane of the microphone 10. The etch stop layer 17 may be removed from the first electrode 19. A hollow space 21 may be formed over the first electrode 19. A second electrode 22 may be formed over the hollow space 21. A second hollow space 24 may be formed over the second electrode 22. A casing 26 may cover the layers of the microphone 10. A passivation layer 28 surrounding the layers, e.g. the functional layers, of the microphone 10 may be formed next to the layer structure of the microphone 10 in a lateral direction. The passivation layer 28 may include silicon nitride, doped or undoped silicon oxide (silica), carbon containing materials, and like. The first and second electrode 19, 22 may be electrically coupled with an energy source (not shown) with the help of first contacts 30, second contacts 32, and third contacts 34. The contacts 30, 32, 34 may include copper and/or gold, Al, Ti, Pt, W, Pd, alloys and/or any stacked combination. A mask 36 may be arranged on the substrate 12 facing away from the layers of the microphone 10, wherein the mask 36 may include a mask recess overlapping the cavity 14 of the microphone 10. The mask 36 may be used for forming the cavity 14 during the wet etching process. After the wet etching process the mask 36 may be removed from the substrate 12.

During an operation of the microphone 10 acoustical waves may enter the cavity 14 and may force the first electrode 19 to vibrate. The vibrating first electrode 19 may lead to a corresponding vibration of the electrical field between the first and the second electrode 19, 22. The vibrating electromagnetic field may cause an electric signal corresponding to the acoustic wave entering the cavity 14. The electric signal may be processed by the microphone 10 or by an integrated circuit (not shown) of the microphone 10 or of an external device (not shown).

Figure 3:
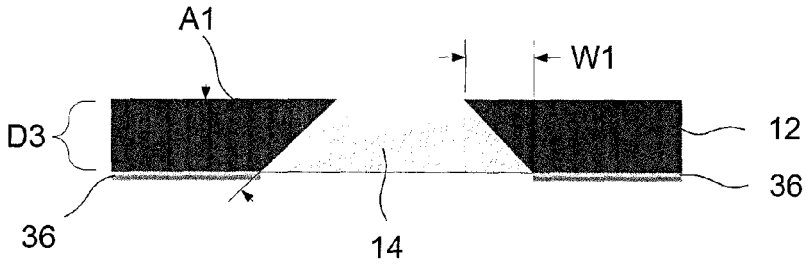
FIG. 3 shows a cross-sectional view of a substrate of a microphone.

FIG. 3 shows a cross-sectional view of the substrate 12 of a conventional microphone. The conventional microphone may have the third thickness D3. The cavity 14 may be formed by a wet etching process. Because of the wet etching process for forming the cavity 14, the cavity 14 may have a circumferential slant. The slant may have a first angle A1. The first angle A1 may be in a range from 0° to 90°. The slant may have a first width W1 in lateral direction. The first width W1 depends on the first angle A1 and on the third thickness D3. The larger the first angle A1 is the smaller is the first width W1. If the first angle is 90°, the first width W1 is zero. The larger the third thickness D3 is the larger is the first width W1.

Figure 4:
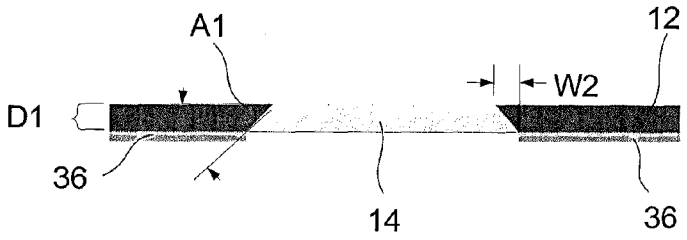
FIG. 4 shows a cross-sectional view of a substrate of an embodiment of a microphone.

FIG. 4 shows a cross-sectional view of the substrate 12 of an exemplary embodiment of the microphone 10. The substrate 12 of the embodiment of the microphone 10 may have the first thickness D1. The cavity 14 may be formed by a wet etching process. The cavity 14 may also have a slant, because of the wet etching process. The slant may have the first angle A1. The first angle A1 may be in a range from 0° to 90°. The slant may have a second width W2 in lateral direction. The second width W2 depends on the first angle A1 and on the first thickness D1. The larger the first angle A1 is the smaller is the second width W2. If the first angle is 90°, the second width W2 is zero. The larger the first thickness D1 is the larger is the second width W2.

The second width W2 is smaller than the first width W1, because the first thickness D1 is smaller than the third thickness D3. In other words, the slant of the embodiment of the microphone 10 has a smaller width than the slant of the conventional microphone. The small width of the slant of the embodiment of the microphone 10 contributes to that each of the microphones 10 needs less space on the substrate 12 and that therefore more microphones 10 may be provided on one wafer compared with the conventional microphone. This may contribute to manufacture the microphones 10 in a cost-saving manner.

Figure 5:
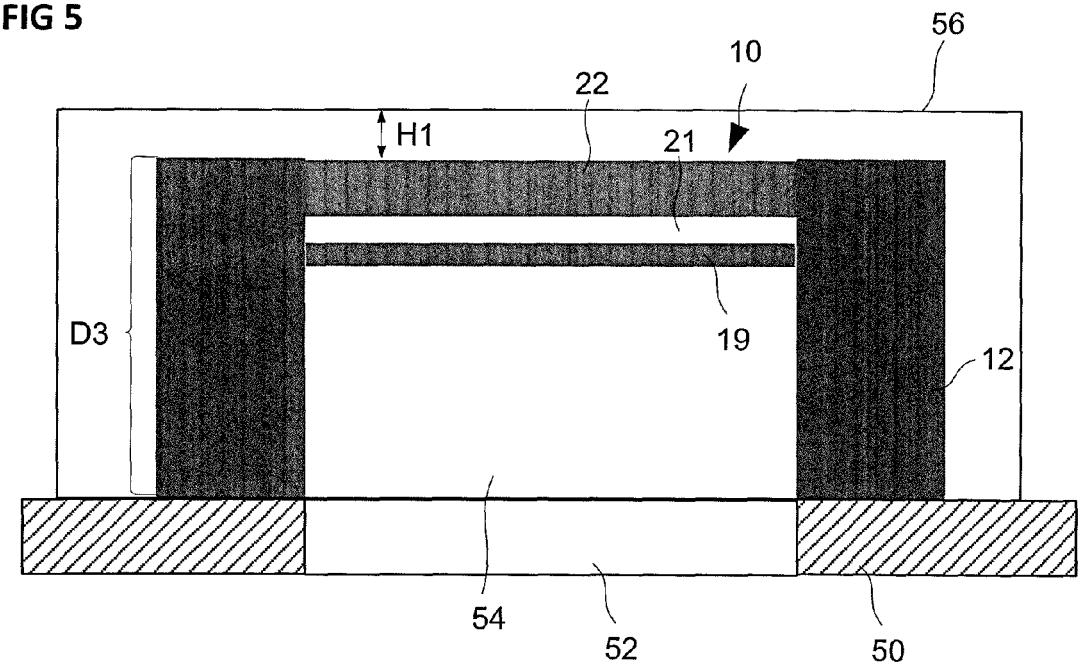
FIG. 5 shows a cross-sectional view of a conventional microphone in a mobile device.

FIG. 5 shows a cross-sectional view of a conventional microphone 10. As a simplification, only a substrate 12, a first electrode 19, a hollow space 21 over the first electrode 19 and a second electrode 22 of the conventional microphone 10 are shown in FIG. 5. Further, a carrier 50 may be arranged, on which the conventional microphone 10 may be arranged. The carrier 50 may include a carrier recess 52. The conventional microphone 10 may be arranged on the carrier 50 such that the first electrode 19 of the conventional microphone 10 may be arranged over the recess of the carrier 52. The carrier 50 may be a part of a casing 56 or package of a mobile device. Because of the large third thickness D3 of the substrate 12 the side of the second electrode 22 facing away from the carrier 50 may be arranged quite far from the carrier 50. In particular, there may be only a first height H1 between the corresponding side of the second electrode 22 and an inner part of the mobile device, the casing 56 or package. Therefore, e.g. in the mobile device, a small back volume may be provided behind the second electrode 22, seen from the carrier 50. The small back volume may contribute to a bad signal to noise ratio of the conventional microphone 10.

Figure 6:
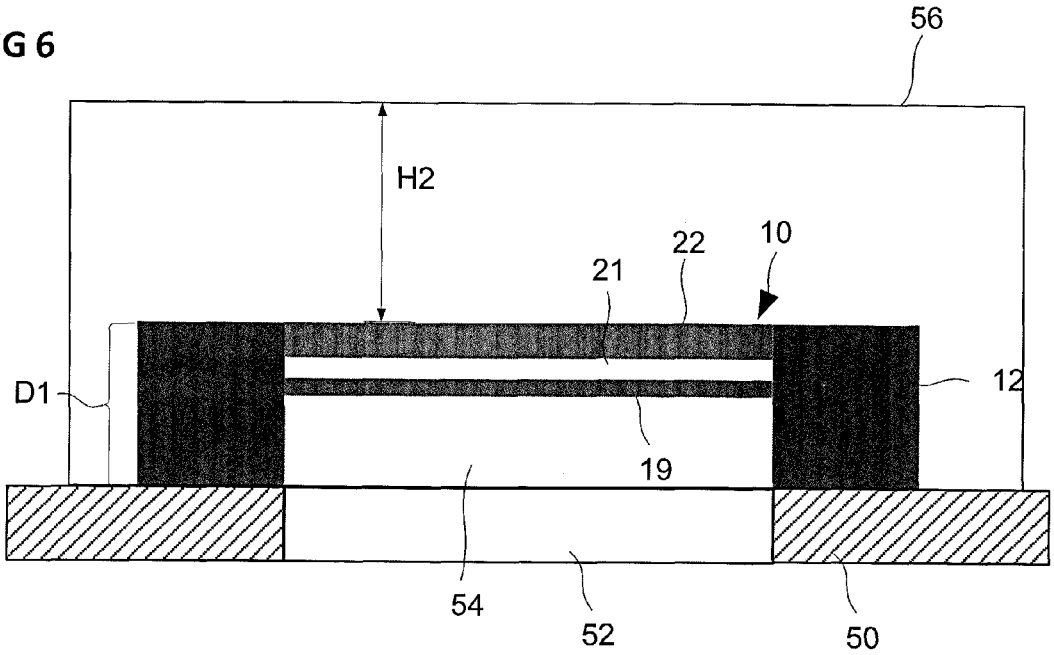
FIG. 6 shows a cross-sectional view of an embodiment of a microphone in a mobile device.

FIG. 6 shows a cross-sectional view of an embodiment of a microphone 10, e.g. the microphone 10 as explained above. As a simplification, only the substrate 12, the first electrode 19, the hollow space 21 over the first electrode 19 and the second electrode 22 of the microphone 10 are shown in FIG. 6. Further, a carrier 50 may be arranged, on which the microphone 10 may be arranged. The carrier 50 may include a carrier recess 52. The microphone 10 may be arranged on the carrier 50 such that the first electrode 19 of the microphone 10 may be arranged over the recess of the carrier 52. The carrier 50 may e.g. be a flat carrier like e.g. a flexible circuit board, or may have a three-dimensional form, e.g. the carrier 50 may be a part of a casing 56 or package of a mobile device (not shown). Because of the small first thickness D1 of the substrate 12 the side of the second electrode 22 facing away from the carrier 50 may be arranged quite near at the carrier 50. In particular, there may be a second height H2 between the corresponding side of the second electrode 22 and an inner part of the mobile device, the casing 56 or package, wherein the second height H2 is larger than the first height H1. Therefore, e.g. in the mobile device, a big back volume may be easily provided behind the second electrode 22, seen from the carrier 50. The big back volume may contribute to a very good signal to noise ratio of the microphone 10.

Figure 7:
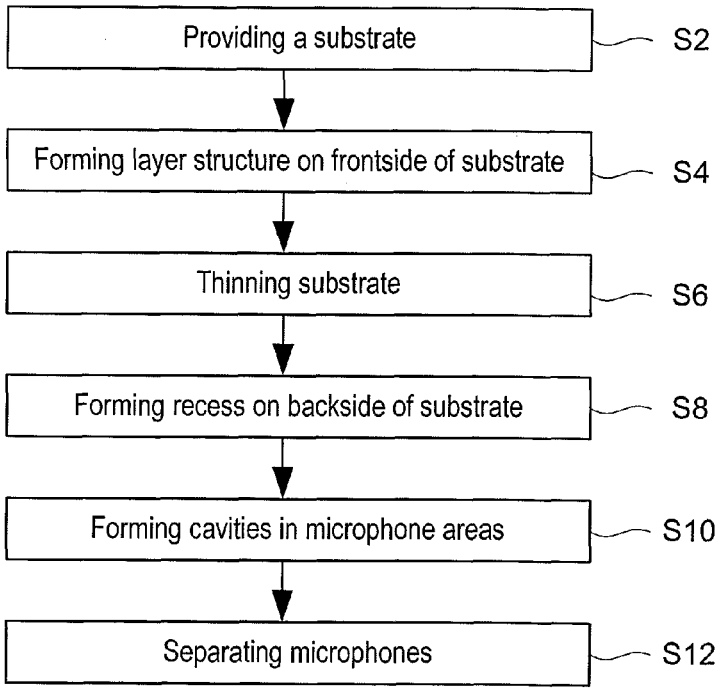
FIG. 7 shows a flow chart of an embodiment of a method for manufacturing a plurality of microphones.

FIG. 7 shows a flowchart of an exemplary embodiment of a method for manufacturing a microphone structure.

In S2 a substrate may be provided, e.g. the substrate 12 as explained above.

In S4 a layer structure may be formed on the front side of the substrate 12. Alternatively the layer structure may be formed on different sides of the substrate 12. The layer structure may be configured to provide the active layers of a microphone, e.g. the microphone 10 as explained above.

In S6 the substrate 12 may be thinned, e.g. by a grinding process. For example, the whole substrate is thinned such that the whole substrate 12 has the second thickness D2.

In S8 the recess may be formed from the backside of the substrate 12. For example the recess may be formed by removing material from the backside of the substrate 12, e.g. by a grinding process, e.g. by a process, in which only the inner area 18 of the substrate 12 is grinded, for example with the help of a stabilization ring.

In S10 cavities may be formed in microphone areas of the substrate 12, e.g. the cavities 14. The cavities 14 may be formed by a chemical etching process.

In S12 the microphone structures, e.g. the microphones 10, may be separated from each other, e.g. by cutting or sawing.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for manufacturing a plurality of microphone structures, the method comprising:

providing a substrate having a front side and a backside, the backside facing away from the front side, and having an inner area and an outer area laterally surrounding the inner area, with the inner area comprising a plurality of microphone areas, each microphone area being provided for one microphone of the plurality of microphones;

forming a plurality of layers for the plurality of microphones in the microphone areas on the front side of the substrate;

forming a recess from the backside of the substrate with the recess laterally overlapping the entire inner area;

forming a plurality of cavities into a bottom of the recess with each cavity of the plurality of cavities being formed in one of the microphone areas;

processing the layers to form the plurality of microphone structures, wherein each microphone structure comprises at least one layer of the plurality of layer and one cavity; and separating the plurality of microphone structures from each other.

2. The method of claim 1, wherein the substrate has a first thickness in the inner area in the recess, wherein the substrate has a second thickness in the outer area outside the recess, and wherein the second thickness is larger than the first thickness.

3. The method of claim 2, wherein the recess is formed such that the first thickness is in a range from about 20 μm to about 400 μm.

4. The method of claim 1, wherein, before the recess is formed, the substrate is thinned such that the substrate has the same thickness.

5. The method of claim 2, wherein the second thickness is in a range from about 300 μm to about 900 μm.

6. The method of claim 1, wherein the cavities are formed by a wet chemical etching process.

7. The method of claim 6, wherein, before the wet chemical etching process, an alkaline resistant photosensitive layer or a hardmask layer structured by a photosensitive layer is provided on the bottom of the recess, an exposure mask is arranged on the backside of the substrate such that the mask is in direct contact with the substrate in the outer area and that there is a given distance between the mask and the bottom in the inner area, wherein the mask comprises a plurality of mask recesses each corresponding to one cavity of the plurality of cavities to be formed in the substrate, and wherein the photosensitive layer or the hardmask layer structured by a photosensitive layer is exposed through the mask recesses of the mask.

8. The method of claim 1, wherein the cavities are formed such that each cavity comprises a circumferential slant, wherein an angle of the slant ranges from about 0° to 90°.

9. A method for manufacturing a plurality of micro-electro-mechanical system microphones, the method comprising:

providing a semiconductor substrate having a first side and a second side, the second side facing away from the first side, and having an inner area and an outer area laterally surrounding the inner area with the inner area having a plurality of microphone areas and an outer area laterally surrounding the microphone areas;

forming a layer structure over the first side of the semiconductor substrate in the microphone areas;

forming a recess from the second side of the substrate with the recess laterally overlapping the entire inner area;

forming at least one cavity in the substrate in each microphone area;

processing the layer structure to provide at least one micro-electro-mechanical system microphone in each microphone area; and separating the micro-electro-mechanical system microphones from each other.

10. The method of claim 9, wherein the substrate has a first thickness in the microphone areas and a second thickness in the peripheral area.

11. The method of claim 10, wherein the recess is formed such that the first thickness is in a range from about 20 μm to about 400 μm.

12. The method of claim 9, wherein, before the recess is formed, the substrate is thinned such that the substrate has the same thickness.

13. The method of claim 10, wherein the second thickness is in a range from about 300 μm to about 900 μm.

14. The method of claim 9, wherein the cavities are formed by a wet chemical etching process or by an anisotropic dry etching process.

15. The method of claim 14, wherein, before the wet chemical etching process, an alkaline resistant photosensitive layer or hardmask is provided on the substrate in the recess, an exposure mask is arranged on the second side of the substrate such that the mask is in direct contact with the peripheral area of the substrate and that there is a given distance between the mask and the substrate in the recess, wherein the mask comprises a plurality of mask openings each corresponding to one of the cavities to be formed in the substrate, and wherein the alkaline resistant photosensitive layer or the photosensitive layer on the hardmask is exposed through the mask openings of the mask.

16. The method of claim 9, wherein the cavities are formed such that each cavity comprises a circumferential slant, in which the thickness of the substrate increases from zero to a first thickness, wherein an angle of the slant ranges from about 0° to 90°.

* * * * *